US006276467B1

(12) United States Patent
Ingmarsson

(10) Patent No.: US 6,276,467 B1
(45) Date of Patent: Aug. 21, 2001

(54) PERCUSSIVE ROCK DRILL BIT WITH ASYMMETRIC WING

(75) Inventor: Karl Ingmarsson, Gainesville, FL (US)

(73) Assignee: Driltech Mission LLC, Alachua, FL (US)

( * ) Notice: Subject to any disclaimer, the term of this patent is extended or adjusted under 35 U.S.C. 154(b) by 0 days.

(21) Appl. No.: 09/425,963

(22) Filed: Oct. 25, 1999

(51) Int. Cl.[7] ..... E21B 10/56
(52) U.S. Cl. ..... 175/415; 175/418
(58) Field of Search ..... 175/414, 417, 175/418, 420.1, 420.2, 415, 431

(56) References Cited

U.S. PATENT DOCUMENTS 3,519,092 * 7/1970 Miller ..... 175/418
4,440,244 * 4/1984 Wiredal ..... 175/292
5,025,875 6/1991 Witt ..... 175/393
5,947,215 * 9/1999 Lundell ..... 175/417

* cited by examiner

*Primary Examiner*—William Neuder
(74) *Attorney, Agent, or Firm*—Burns, Doane, Swecker & Mathis, L.L.P.

(57) ABSTRACT

A percussive rock drill bit includes a steel bit body and carbide button inserts mounted in a front cutting face thereof. The bit body includes a passage intersecting the front cutting face for conducting a flushing/cooling medium to the front cutting face. The flushing/cooling medium travels to an outer periphery of the bit body and travels upwardly within flushing grooves formed in the outer periphery of the bit body. Portions of the bit body situated between successive ones of the flushing grooves constitute wings of the bit body. Some of the button inserts constitute gauge inserts. Only a gauge insert is mounted in each wing. At least some, possibly all, of the gauge inserts are offset circumferentially from a center of the respective wing toward a trailing end of the wing.

7 Claims, 2 Drawing Sheets

PERCUSSIVE ROCK DRILL BIT WITH ASYMMETRIC WING

BACKGROUND OF THE INVENTION

The present invention relates to percussive rock drill bits, such as used in percussive down-the-hole hammers and top-hammer drills, for example, which bits comprise a steel body carrying hard button inserts. The body includes a plurality of wings. In particular, the invention relates to such drill bits wherein only a single gauge button is disposed in each wing of the drill bit.

Such a drill bit 10 is depicted in FIG. 1 (and also in U.S. Pat. No. 5,025,875). The drill bit includes a steel bit body 12 forming a front cutting face that is intersected by two fluid passages 14 for conducting a flushing/cooling medium (e.g., air) to the front cutting face. Each passage 14 communicates with a radial channel 16 in the cutting face for conducting the flushing/cooling medium to an outer periphery of the bit body, in particular, to respective longitudinal flushing grooves 18' formed in the bit body for facilitating the longitudinal flow of the medium. Additional longitudinal flushing grooves 18 are provided, all of the flushing channels 18, 18' being in circumferentially spaced relationship with one another. Disposed between successive flushing channels in the circumferential direction are so-called wings 20, 20' of the bit body, wherein the wings 20' are situated immediately behind the flushing grooves 18' with reference to the rotation direction d.

Mounted in longitudinal holes formed in the front cutting face are button inserts 22, 23, 23' formed of a hard material such as cemented carbide, especially tungsten carbide. The inserts 23, 23' are mounted in the wings 20, and are known as gauge inserts because they define the diameter of the hole being cut. Two of the gauge inserts 23' are mounted in the wings 20' that are situated immediately behind the flushing grooves 18'. The remaining gauge inserts 23 are mounted in the other wings 20.

FIG. 1 depicts a type of drill bit wherein only a single gauge insert 23, 23' is disposed in each wing 20, 20' (other conventional types of drill bits may have more than one gauge insert in each wing, but the present invention does not pertain thereto.) Typically, in such a drill bit, each gauge insert is located at the center of the respective wing, with reference to a circumferential dimension of the wing. In other words, if the direction of rotation of the drill bit is in the direction d, then the distance A from the center of the gauge insert 23, 23' to a leading edge 24 of the wing 20, 20' is equal to the distance B from the insert center to the trailing edge 26 of the wing, this being the case for all of the gauge inserts.

During rotation of the drill bit, the leading portion of each wing, i.e., the leading edge 24 of the wing, is more exposed than is the trailing edge 26. Consequently, the leading edge wears more rapidly, sometimes limiting the life of the bit. This can happen while the trailing edge remains relatively intact. That is especially true of the wings that are situated immediately downstream of the flushing grooves 18' disposed at radially outer ends of the radial channels 16.

It has been proposed in the prior art to deal with the above-described wear problem by making the flushing grooves narrower, thus extending the total wing length and the total amount of steel. Another solution is to increase the hardness and wear resistance of the steel. Yet another solution is to add wear protection buttons on the outside of the wing. It is not uncommon to put the wear protection buttons on the leading ledge. However, these solutions have drawbacks in regards to flushing capacity of the design, fatigue resistance of the steel and/or manufacturing cost.

SUMMARY OF THE INVENTION

A percussive rock drill bit includes a bit body and a plurality of button inserts mounted in the bit body. The bit body forms a front cutting face and a peripheral surface. At least one passage intersects the front cutting face for conducting a flushing/cooling medium to the front cutting face. The peripheral surface has a circumferentially spaced flushing grooves formed therein. Portions of the bit body which are disposed between successive flushing grooves comprise wings. Each wing having a leading edge and a trailing edge. The button inserts are formed of a material harder than the material of the bit body. Some of the button inserts constitute gauge inserts and are mounted in the wings. There is only one gauge insert mounted in each wing. At least one of the gauge inserts is offset circumferentially from a center of the respective wing by a distance equal to at least five percent of a circumferential length of the wing.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
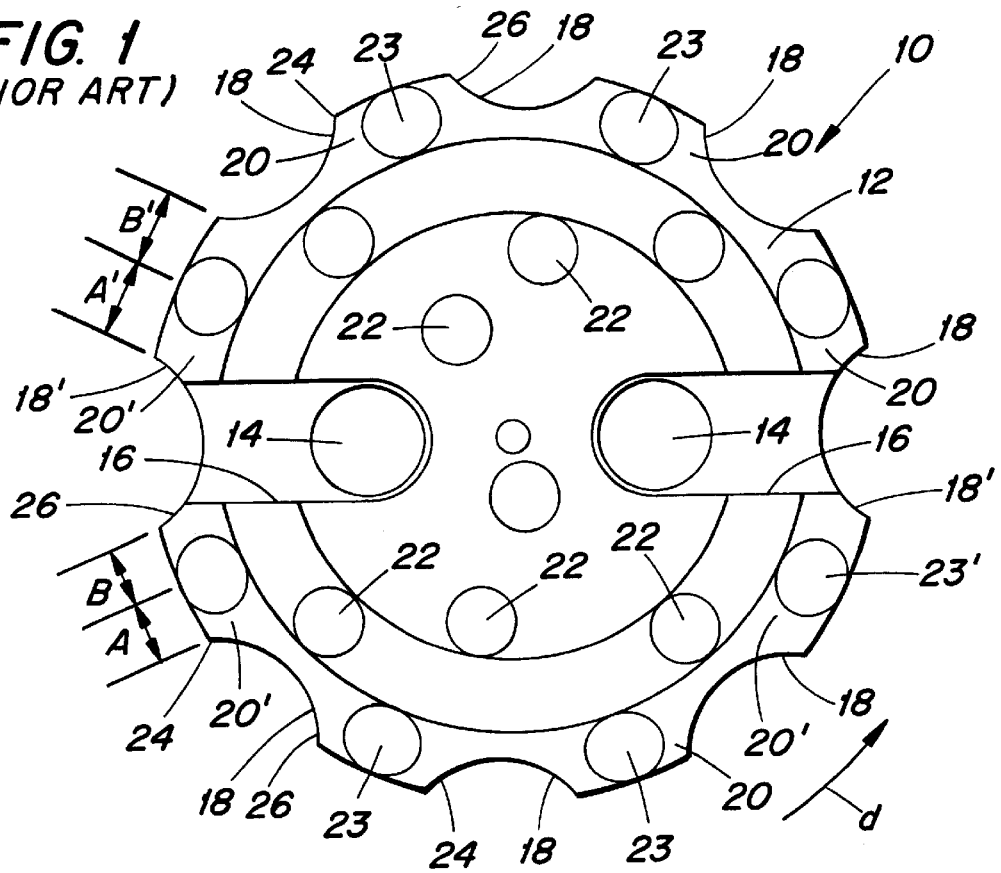
FIG. 1 (PRIOR ART)
FIG. 1 is a front elevational view of a prior art cutting bit of the type having only one gauge insert in each wing.
Figure 2:
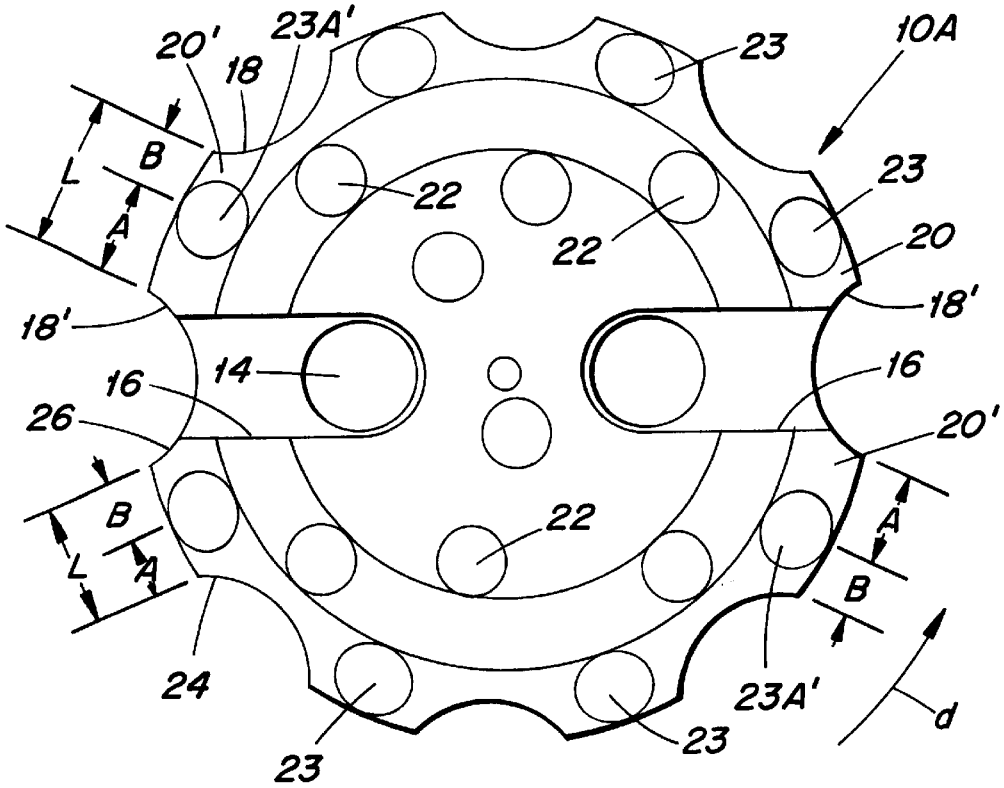
FIG. 2 is a view similar to FIG. 1 depicting a first embodiment of the present invention.

A first embodiment of a percussive rock drill bit 10A according to the invention is depicted in FIG. 2. The parts thereof corresponding to the prior art drill bit of FIG. 1 are provided with the same reference numerals. The structure of the drill bit 10A is identical to the prior art drill bit 10 of FIG. 1, except for the two gauge inserts 23A' which are mounted in the wings 20' situated immediately behind the two flushing grooves 18' that are located at the radially outer ends of the radial channels 16. Those gauge inserts 23A' (two in number in FIG. 2) are not located at the circumferential center of the wings 20' as in the prior art, but rather are located closer to the trailing edge 26. (That is, in FIG. 2, A'>B'.) That is not true of the other gauge inserts 23, wherein A=B.

As a result, the amount of steel disposed between each insert 23A' and the leading edge 24 of the respective wing 20' is increased as compared to the prior art, whereby there is more steel to withstand the higher rate of wear during a drilling operation. Accordingly, the life of the drill bit is increased as compared with the prior art.

The amount by which the gauge insert 23A' is offset from the wing center is at least 5% of the circumferential length L of the wing 20'. That is, $(A'-L/2)>0.05L$ in FIG. 2.

The bit can be used in percussive down-the-hole hammers as well as in top-hammer drills. It should be noted, however, that since down-the-hole hammers are rotated in a clockwise direction, whereas top hammer drills are rotated in a counterclockwise direction, the direction in which the wing inserts are offset from wing midpoint is different, depending upon the type of drill being used.

Figure 3:
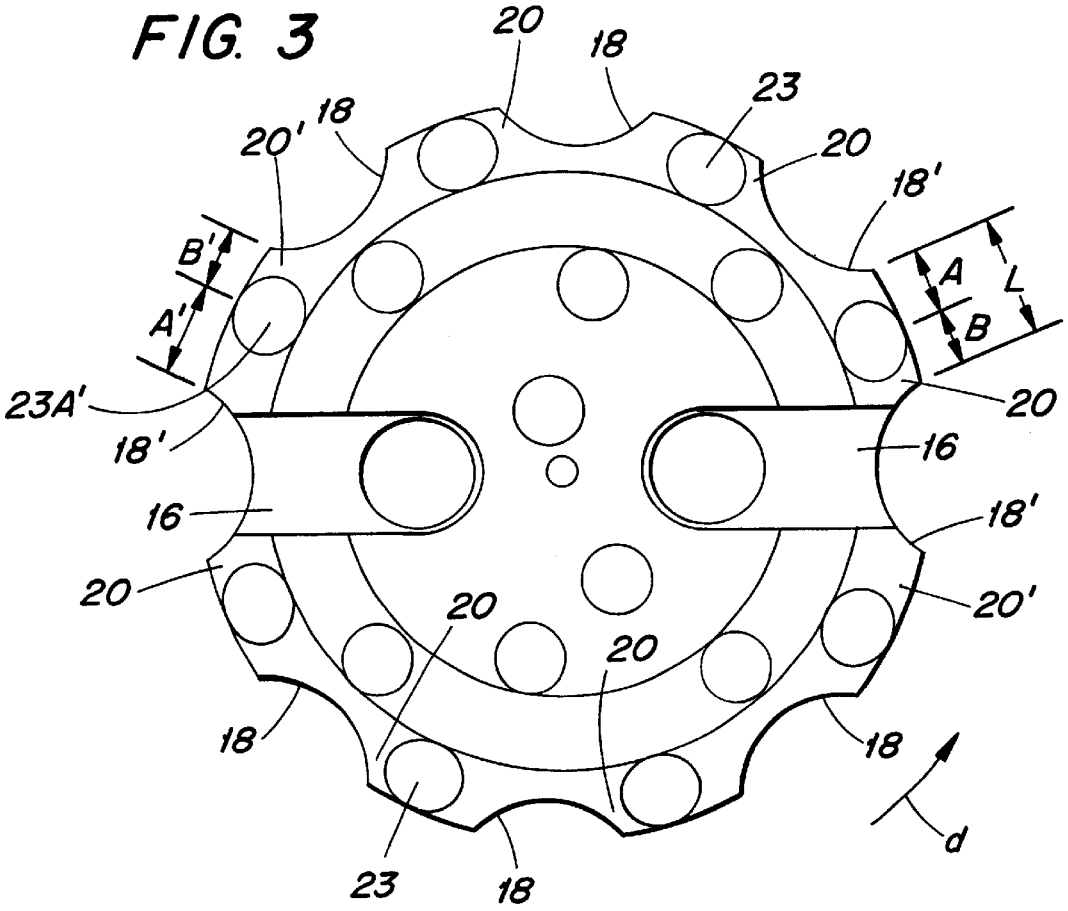
FIG. 3 is a view similar to FIG. 2 depicting a second embodiment of the invention.

The embodiment of the invention depicted in FIG. 3 is identical to the embodiment of FIG. 2, except that in FIG. 3 every one of the gauge inserts 23, 23A' is offset rearwardly from the center of the respective wing. That is, preferably at each wing (A–L/2)>0.05L, or (A'–L/2)>0.05L.

Figure 4:
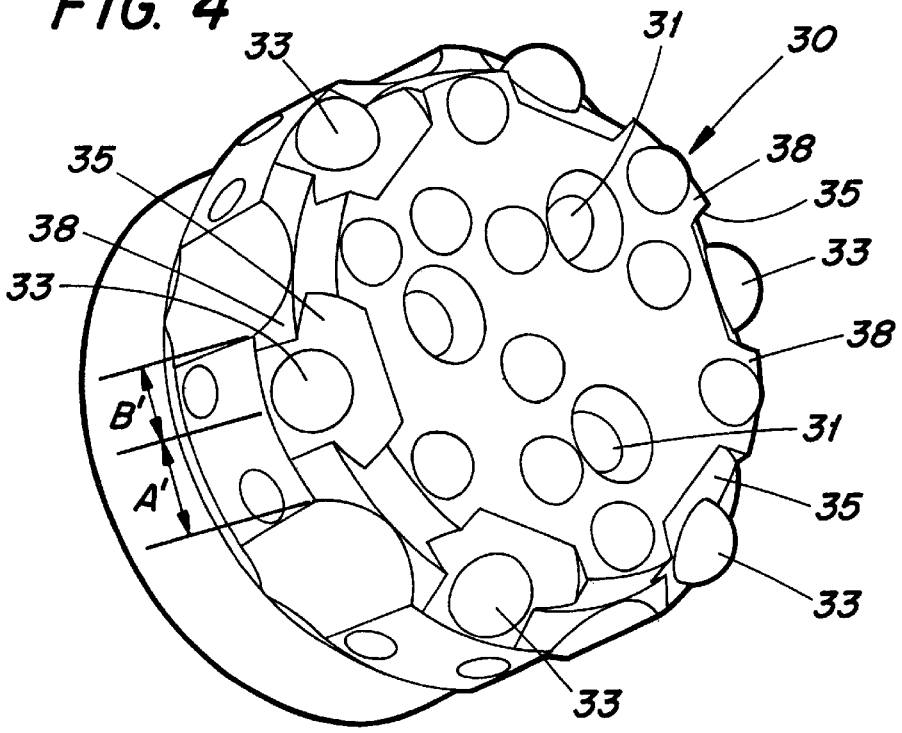
FIG. 4 is a perspective view of a third embodiment of the invention.

In the embodiment according to FIG. 4, a different type of percussive rock drill bit 30 is depicted wherein the front cutting face is intersected by flushing passages 31, but no radial channels are present. Also, the gauge inserts 33 are situated in recesses 35 formed in each wing 38. Each of the gauge inserts 33 is offset rearwardly from a gauge center. That is in FIG. 4, (A–L/2)>0.05L.

What is claimed is:

1. A percussive rock drill bit comprising:

a bit body forming a front cutting face and a peripheral surface, at least one passage intersecting the front cutting face for conducting a flushing/cooling medium to the front cutting face, the peripheral surface having circumferentially spaced flushing grooves formed therein, portions of the bit body disposed between successive flushing grooves comprising wings, each wing having a leading edge and a trailing edge;

a plurality of button inserts mounted in the bit body, the button inserts formed of a material harder than the material of the bit body, some of the button inserts constituting gauge inserts and mounted in the wings, there being only one gauge insert mounted in each wing, wherein the cutting face includes a radial channel associated with the at least one passage for conducting flushing/cooling medium from the passage to one of the flushing grooves, one of the wings being situated immediately behind the one flushing groove, the gauge insert mounted in the one wing constituting an offset gauge insert which is offset circumferentially from a center of the one wing in a direction away from the leading edge, by a distance equal to at least five percent of a circumferential length of the wing.

2. The drill bit according to claim 1 wherein there are at least two passages, and at least two radial channels, wherein at least two of the gauge inserts are offset from centers of their respective wings.

3. The drill bit according to claim 1 wherein each of the gauge inserts on the bit body constitutes an offset gauge insert which is offset from the center of its respective wing in a direction away from the leading edge thereof by at least five percent of the wing length.

4. The drill bit according to claim 1 wherein each wing includes a recess, the gauge inserts being mounted in respective ones of the recesses.

5. The drill bit according to claim 1 wherein the bit body is formed of steel, and at least some of the button inserts are formed of cemented carbide.

6. The drill bit according to claim 1 wherein the bit body is formed of steel, and at least some of the button inserts are diamond-enhanced.

7. A percussive rock drill bit comprising:

a bit body forming a front cutting face and a peripheral surface, at least one passage intersecting the front cutting face for conducting a flushing/cooling medium to the front cutting face, the peripheral surface having circumferentially spaced flushing grooves formed therein, portions of the bit body disposed between successive flushing grooves comprising wings, each wing having a leading edge and a trailing edge;

a plurality of button inserts mounted in the bit body, the button inserts formed of a material harder than the material of the bit body, some of the button inserts constituting gauge inserts and mounted in the wings, there being only one gauge insert mounted in each wing, all of the gauge inserts being offset circumferentially from a center of the respective wings in a direction away from the leading edge thereof, by a distance equal to at least five percent of a circumferential length of the respective wing.

* * * * *